United States Patent [19]

Nelson

[11] 3,994,678

[45] Nov. 30, 1976

[54] HEATER FOR BILLETS

[75] Inventor: John W. Nelson, Wyoming, Mich.

[73] Assignee: Oliver Machinery Company, Grand Rapids, Mich.

[22] Filed: May 12, 1975

[21] Appl. No.: 576,596

[52] U.S. Cl. ..... 432/145; 432/128; 432/153

[51] Int. Cl.[2] ..... F27B 9/00

[58] Field of Search ..... 432/8, 14, 18, 50, 128, 432/150, 176, 153, 143–146, 11; 219/388, 59

[56] References Cited

UNITED STATES PATENTS

| | | | |
|---|---|---|---|
| 3,172,647 | 3/1965 | Remmey | 432/145 |
| 3,186,694 | 6/1965 | Beggs | 432/59 |
| 3,539,100 | 11/1970 | Scanlon et al. | 432/50 |
| 3,837,794 | 9/1974 | Phillips | 432/18 |
| 3,905,764 | 9/1975 | Birke et al. | 62/2 |

*Primary Examiner*—John J. Camby
*Assistant Examiner*—Henry C. Yuen
*Attorney, Agent, or Firm*—Price, Heneveld, Huizenga & Cooper

[57] ABSTRACT

An apparatus for heating materials such as aluminum billets to a temperature suitable for extrusion is disclosed. The apparatus has at least two zones arranged in tandem, a preheat zone and one or more primary heating zones. Every zone has inner and outer chambers. The outer chamber is supplied with high temperature gas at a pressure in excess of that of the inner chamber. The chambers are separated by baffles which define narrow slot-like aspirating throats through which secondary gases from a secondary source are jetted after entraining high temperature gases from the primary chamber. The secondary gases are at a lower temperature to provide efficient impingement of the gases on a target such as a billet with the primary gases providing the principle heat source. The apparatus is of the closed type utilizing rapid recycling of gases for efficient use of thermal energy.

14 Claims, 8 Drawing Figures

HEATER FOR BILLETS

BRIEF SUMMARY OF THE INVENTION

This invention relates to apparatus for heating an elongated piece of material such as a metallic billet to a temperature at which the material can be worked by compressive forces. The invention is particularly useful for heating a billet of aluminum to a temperature at which it can be effectively extruded. The invention utilizes an arrangement in which the billet is passed through a small, elongated chamber which, itself, is within a larger chamber of high temperature gases. The two chambers are separated by baffle means shaped to provide elongated, narrow throats. Adjacent these throats, jets of high pressure, heated gas are discharged through the throats against the billets as the billets pass through the apparatus. The gas discharged under pressure to form the jets is at a substantially lower temperature than the gas in the vicinity of the jets. The jets effectively entrain quantities of the high temperature gas from the surrounding area and mix it with the cooler, high velocity gases and impinge the mixture on the surface of the billet. By reason of the impingement technique, the rate of thermal transfer between the gases and the billet is substantially increased and the heating is more uniform.

No flame is used either impinging upon or in the vicinity of the billet. In the preferred method of heating the gases, an electrical heating source is utilized but other thermal sources can be utilized. Since an electrical heat source does not require an adequate supply of oxygen to support combustion, the heated gases can be recirculated as much as once each second past the heating source. This represents a very considerable savings in thermal energy.

The use of the jets to force the heated gases to impinge upon the surface of the billet substantially accelerates the rate of heat transfer. Thus, the time the billet has to remain in the apparatus to attain the desired temperature is materially reduced. Thus, again the thermal efficiency of the unit is increased. The particular design of the unit in which an efficient aspirating zone is provided adjacent the jet nozzles assures entrainment of a high percentage of the high temperature gases, thus, effecting rapid heat transfer.

DESCRIPTION OF THE PREFERRED EMBODIMENT

Figure 1:
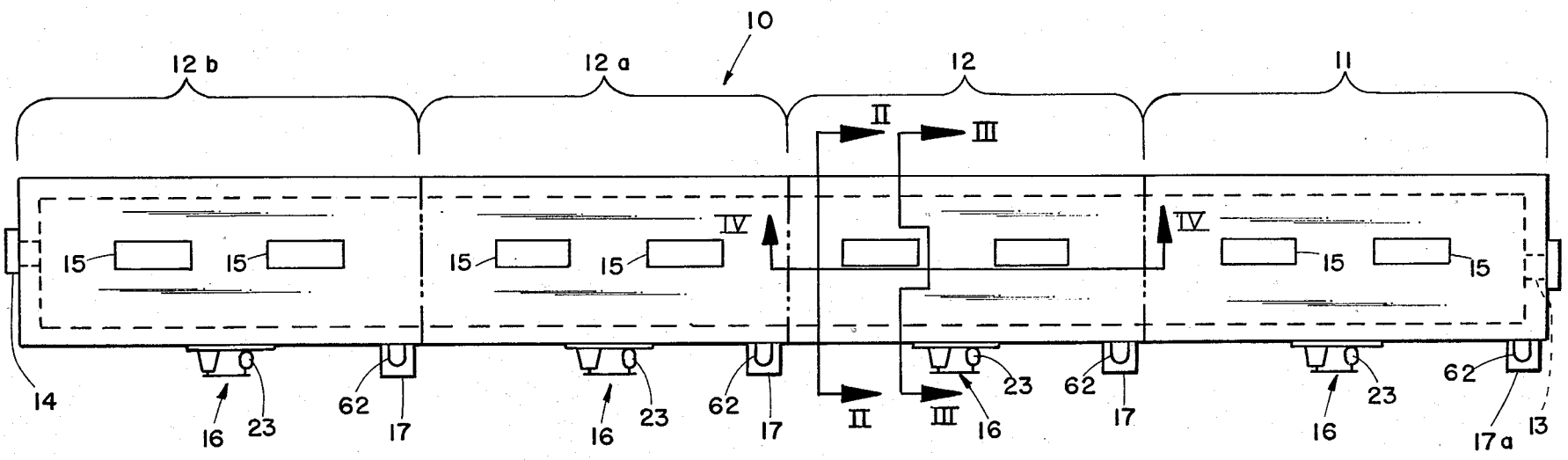
FIG. 1 is a somewhat schematic plan view of the invention.

Referring to FIG. 1, the numeral 10 indicates an elongated billet heater consisting of a preheater section 11 and, in addition, at least one and, in the particular embodiment illustrated, three primary heating sections 12, 12*a* and 12*b*. The sections are arranged in tandem, and are so designed as to form a continuous tunnel extending from a billet receiving opening 13 to a billet discharge opening 14. Each section has its own individual heat source such as the heating elements 15. Each section has its own individual fan system 16 for circulating the primary or high temperature gases. Each section has its own individual fan unit 17 for pressurizing and circulating the secondary air. In FIG. 1, these are only illustrated schematically.

Figure 3:
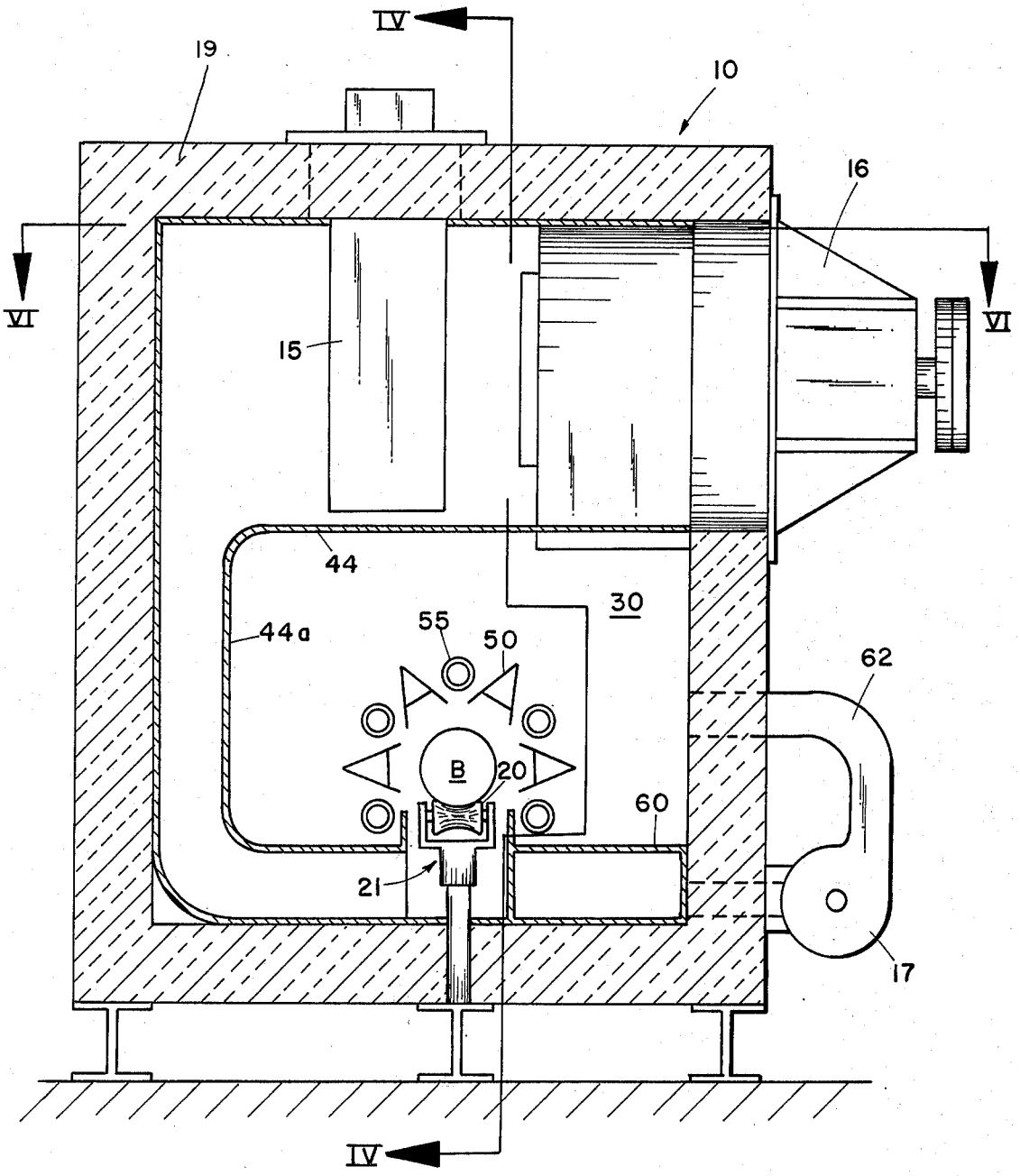
FIG. 3 is a sectional elevation view taken along the plane III—III of FIG. 1.
Figure 4:
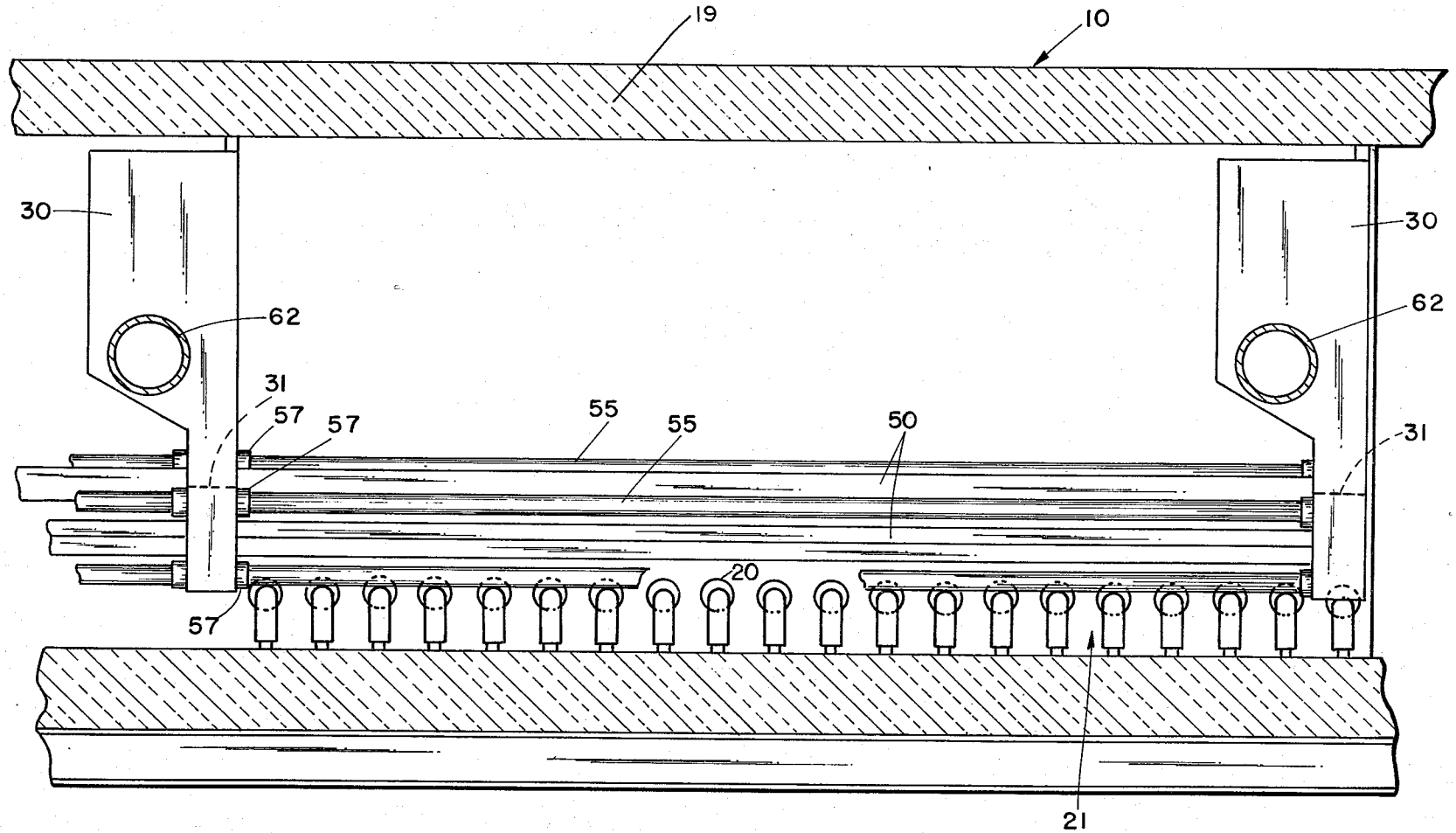
FIG. 4 is a sectional elevation view taken along the plane IV—IV of FIG. 3 with the primary air system deleted for purposes of clarity.

FIGS. 3 and 4 illustrate a typical, single zone or section such as the preheater section 11 or any of the primary heating sections 12, 12*a* or 12*b*. In the preferred embodiment of this invention, each of these sections is approximately ten feet in length. Each section has a plurality of suitably spaced rollers 20 forming a billet transporting track 21 extending along the center of the apparatus. The billets enter through the entrance 13 and are pushed along the track 21 by any suitable means such as the billets being supplied one after the other with the one entering at the right-hand end of FIG. 1, forcing the lead billet out through the discharge opening 14 on the left-hand end of FIG. 1. Each section has a pair of the heaters 15 mounted to the roof of the unit (FIGS. 1 and 3). Each zone or section has its own separate fan assembly 16 driven through belts or other suitable means by an externally mounted electric motor 23.

Figures 6, 8:
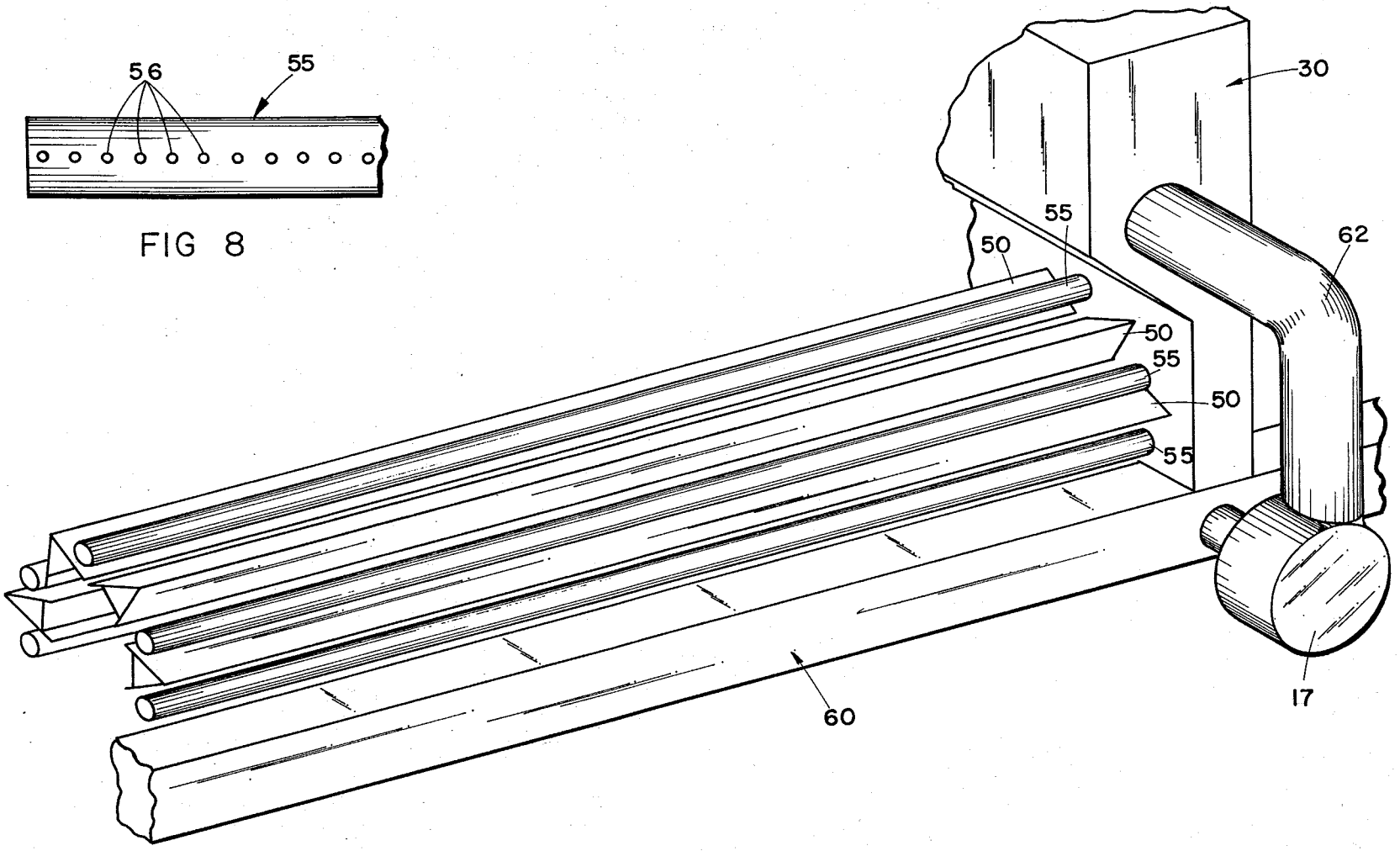
FIG. 6 is an oblique view of the billet heating mechanism including a fragmentary view of the secondary air source.
FIG. 8 is a fragmentary sectional view taken along the plane VIII—VIII of FIG. 7.

At the beginning or upstream end with respect to the direction of movement of the billets through the apparatus, each section is equipped with a plenum chamber 30 (FIGS. 4 and 6). As will be seen in FIG. 2, an opening 31 is provided below the plenum chamber to permit the billet B to pass. The plenum chambers 30 serve as separators or dividers between each of the sections. They also serve as the air supply for the hereinafter described secondary or pressurized air system.

Figure 5:
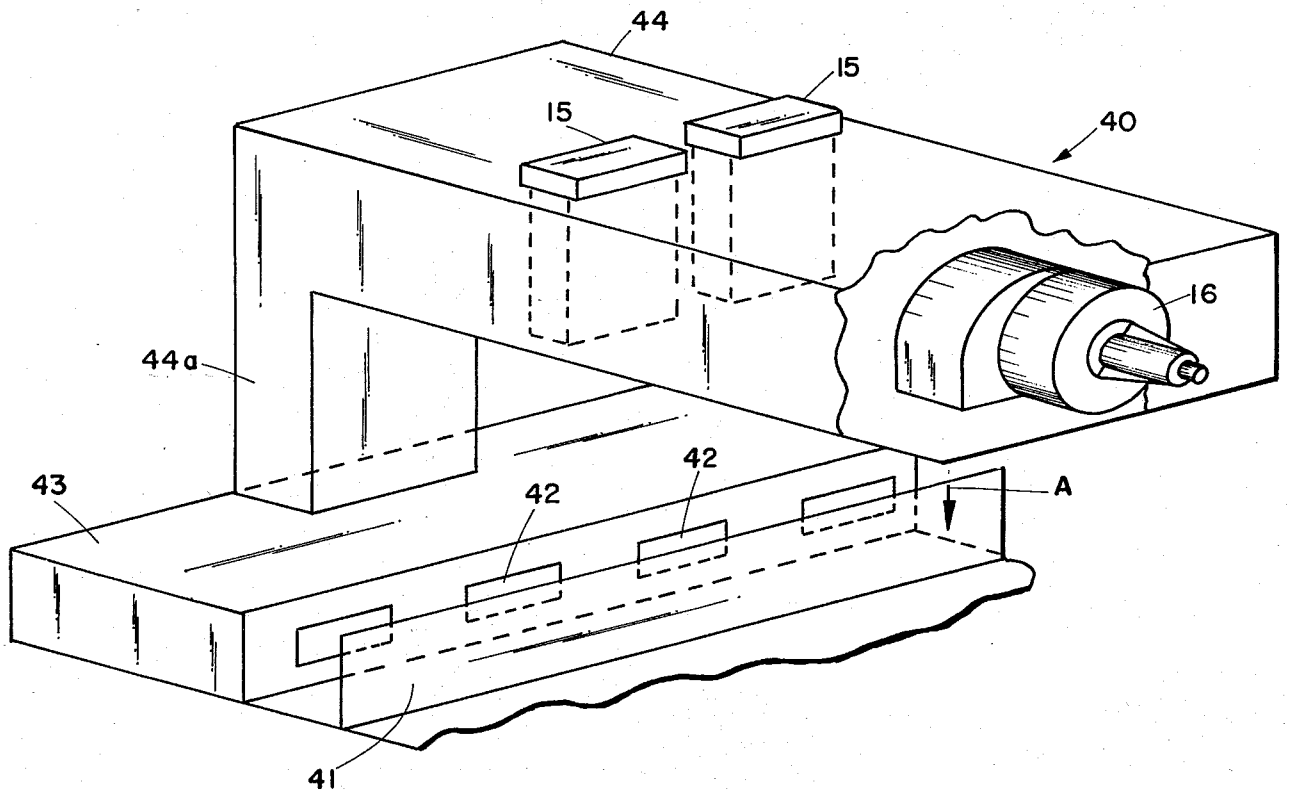
FIG. 5 is an oblique view of a typical primary air system for one zone of the invention.

In each section, between the plenum chambers 30, the apparatus has a primary or high temperature air circulation system 40 (FIG. 5). The primary air system has a generally U-shaped trough 41 defined by sides 41a seated about the lower portion of the conveyor track 21. Suitable spaced conduits 42 connect it to the primary air return duct 43 from which air is withdrawn by the fan 16 through the return ducts 44 and 44a. The air return duct 43 extends the length of a section. No communication is provided between the return ducts in adjacent sections.

Figure 2:
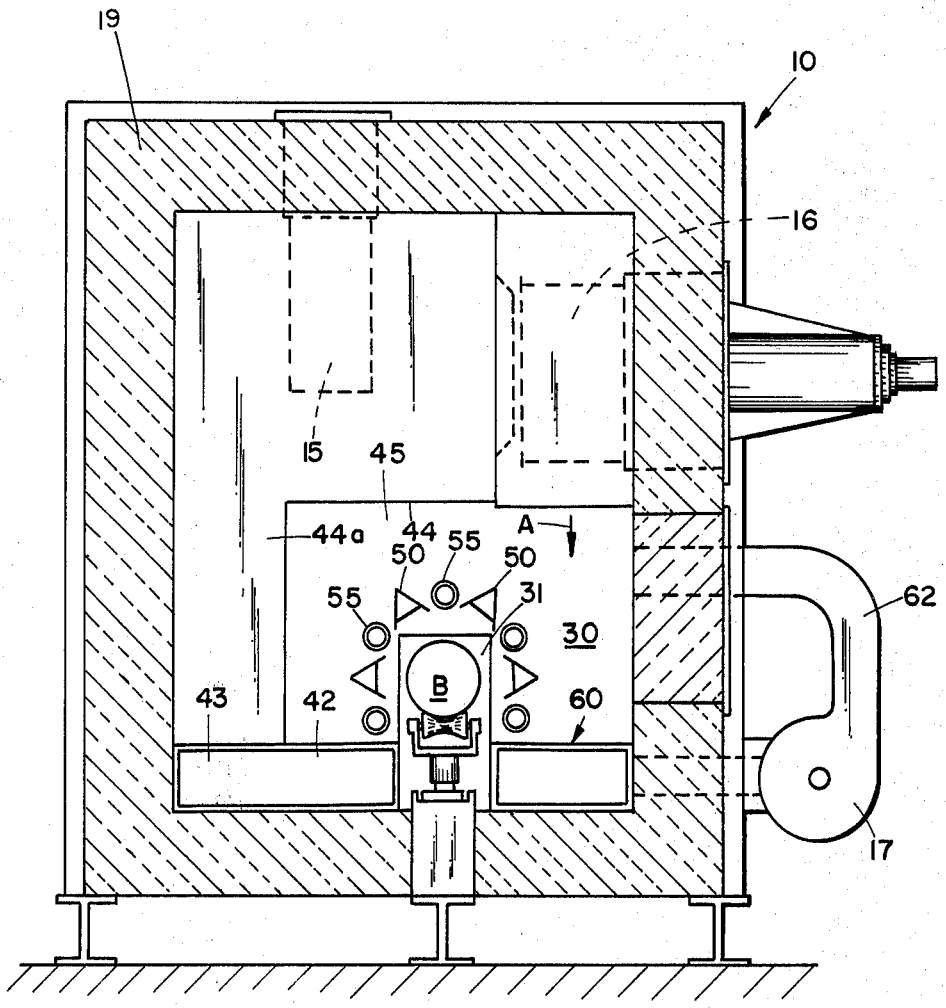
FIG. 2 is a sectional elevation view of the invention taken along the plane II—II of FIG. 1.

Mounted in the return duct 43 are a pair of heaters 15. These heaters can be of any type capable of providing sufficient thermal energy to enable the apparatus to function efficiently. For example, they could be gas, oil or powdered coal fired or in the preferred embodiment illustrated, they are electrical. The air after being heated by the heaters 15 is discharged by the fan 16 into the outer or primary air chamber 45 in in the direction of the arrow A (FIGS. 2 and 5). This primary air chamber, in effect, is a tunnel surrounding the path the billet B travels through the apparatus. This tunnel is encased by insulation 19 to reduce thermal losses.

Figure 7:
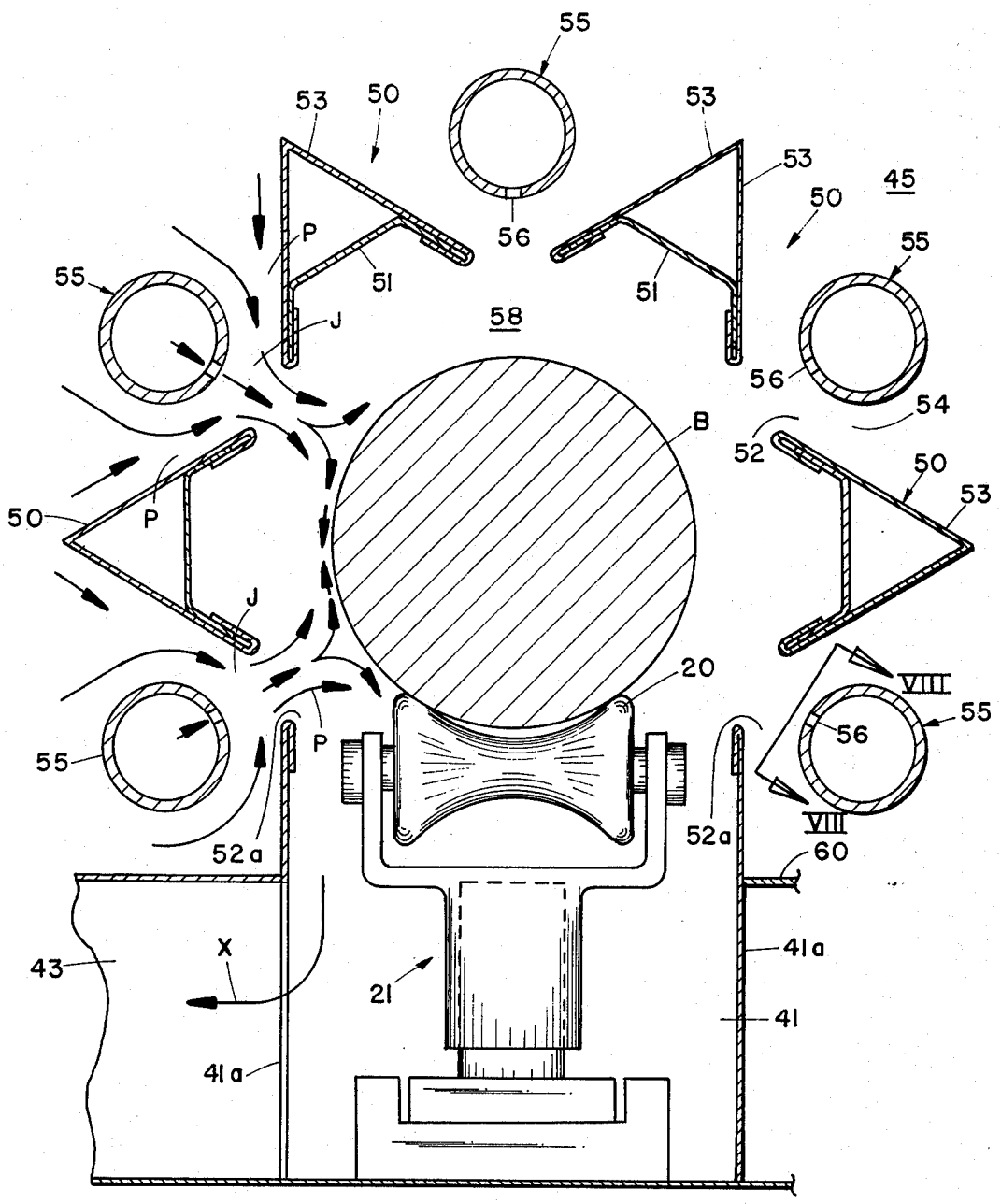
FIG. 7 is an enlarged, fragmentary view of the inner chamber or tunnel immediately surrounding the billet.

At approximately the center of the chamber 45 a plurality of baffles 50 extend the length of the chamber (FIGS. 2, 4 and 6). These baffles are generally triangular in shape and are arranged circumferentially about the area occupied by the billet B as it moves through the apparatus (FIG. 2). As will be seen in FIGS. 2, 6 and 7, in the preferred arrangement, four of these triangular shaped baffles 50 are provided, each having a base 51 facing the billet B. The baffles are located in such a manner as to create a narrow, restricted slot-like throat 52 between each pair of baffles. The walls 53 of adjacent baffles form a shallow V converging toward the throat 52. The V-shaped area between the baffles forms an aspiration zone 54. The bottom one of the baffles 50 on each side cooperates with the adjacent wall 41a of the trough 41 to form a restricted throat 52*a*.

Mounted in each of the aspiration zones 54 is a tubular air supply member 55. Each of the air supply tubes 55 has a plurality of small orifices 56 opening from the tube toward the billet B through the center of the throat 52. In the preferred embodiment illustrated in FIG. 8, these orifices 56 are shown as small individual holes. It will be recognized that a narrow, continuous slot could also be used.

This arrangement of alternate baffles and secondary air supply members extends the full length of each of the sections. The tubes 55 and baffles 50 together define a somewhat circular inner chamber 58 closely surrounding the billet. Thus, the air chamber within the apparatus is divided into inner and outer portions or chambers. In the arrangement illustrated in FIG. 4, each of the plenums 30 serves one section. It is entirely feasible to serve two sections with a single plenum with the air supply tubes 55 and baffles 53 extending from opposite sides of the plenum. In this case, a simple wall would be provided between alternate sections since the plenum chamber will have been eliminated.

Irrespective of whether each plenum services one or two sections, the free ends of the baffles 53 and tubes 55 are preferably supported by suitable means such as the cups 57 (FIG. 4). These cups are so designed that the baffles and tubes may freely slide lengthwise in them to accommodate thermal expansion and contraction.

The air for the plenum chambers 30 is obtained from the secondary air duct 60 (FIG. 6). The secondary air duct extends substantially the full length of the apparatus. It has an intake opening in the preheat section 11. At each of the plenums serving one or more of the primary heating sections 12, 12*a* and 12*b*, it is interconnected with the plenum 30 by a fan 17 and an air duct 62. The fan 17*a* corresponding to the fans 17 for the primary heating sections 12, 12*a* and 12*b* is not connected to the secondary air duct 60. The fan 17*a* obtains its air directly from the preheat chamber.

The purpose and significance of the baffles, air supply tubes and of the dual air supply arrangement will be described in detail under Operation.

OPERATION

In the operation of this apparatus, the material passed through the equipment is heated entirely by transfer of thermal energy from high temperature gases to the target or, as illustrated in this case, the billet B. Although the gases are at high temperatures, there is no open flame or combustion in the vicinity of the billet, itself.

The billet is introduced to the process by pushing it through the entrance 13 where it will roll along the conveyor track 21. The entrance is restricted in size to prevent excessive loss of heated gases. When the billet has been fully inserted into the preheat section 11, a suitable door of conventional construction closes the entrance 13 to prevent further loss of thermal energy.

In the preheat section, the primary air is heated to approximately 1000° F. This air fills the chamber 45 and is being constantly circulated by the fan 16. As the air passes around the billet, it loses a substantial portion of its thermal energy and thereby is cooled into the range of 400°–700° F. A portion of this cooled air is withdrawn by the fan 17*a* and injected under pressure into the plenum 30 serving the air supply tubes 55 for the preheat section. The fan 17*a* places this air under substantial pressure whereby it is forced to discharge in the form of a jet through the openings 56 in the air supply tubes 55. This air, after it has been impinged against the billet is once again either recirculated through the heaters and the fan 16 to the main chamber or, a portion of it is withdrawn by the fan 17*a* for use in the secondary air supply or a further portion is withdrawn by the air return duct 60 and, thus, leaves the preheat chamber entirely.

The air withdrawn through the duct 60 provides the sole air supply for the plenum chambers 30 for each of the subsequent primary heating sections 12, 12*a* and 12*b*. In this connection, it should be remembered that the number of sections involved in a particular apparatus is a matter of design choice. In some cases, only one or perhaps two primary heating sections such as 12 or 12*a* may be used. However, in other cases, it may be necessary to use four, five or even six primary heating sections in order to raise the particular billets to the required temperature.

At each of the plenum chambers 30, in each of the primary heating sections, the fan 17 serving that plenum chamber draws a portion of the gases off from the duct 60 and places them under pressure in the plenum chamber. This air is in the range of 400°–700° F. and is returned to the system by being jetted from the orifices 56 of the secondary air supply tubes 55 in each of the primary heating sections.

The function of the equipment will now be explained. So far as the baffles 50 and the air supply tubes 55 are concerned, the operation is identical in all sections whether it is the preheat section or a primary heat section. The air jets created by the high velocity discharge of the pressurized air through the orifices or nozzles 56 of the secondary air supply tubes creates a Venturi-type of action in the adjacent, restricted throat between the baffles 50. Because of the location of these jets at the center of this throat, and because of the sloping or converging walls of the baffles the jets are particularly effective in inducting or entraining large quantities of the heated gases that are in the chamber 45 surrounding the baffles and tubes. Thus, the jets effectively cause a mixture of the secondary gases from the jets and entrained quantities of primary gases from the chamber 45 to be impinged directly on the billet B. This is schematically illustrated on the left-hand side of FIG. 7. It has been omitted from the remainder of FIG. 7 for the sake of clarity. The jet "J" of cooler secondary air is illustrated entraining substantial quantities of very hot primary air "P". The mixture of these airs is impinged against the surface of the billet B with substantial force and then is largely withdrawn into return duct 43 as indicated by the arrow X. A small portion of the air follows the tunnel 58 back to the preheat section 11.

The cooler and thus denser and heavier gases discharged from the tubes 55 are a much more effective jet than would be gases heated to a higher temperature. Thus, for the high temperatures needed to raise the material to the desired temperature, the gases in the chamber 45 are at much higher temperatures than the gases in the tubes. It has been found that a suitable temperature range for the secondary or jet gases is 400°–700° F. while the primary gases in the chamber 45 are heated to 1000°–1500° F. These temperatures have been found to be satisfactory for heating an aluminum billet to a temperature suitable for extrusion. With other materials, both the overall gas temperature range and the differential between the primary and secondary gases may be changed.

Because the lower temperature gases of the jets are heavier and denser, they will effect a much stronger impingement on the surface of the billet. Since they have entrained large quantities of high temperature gas, they provide an effective means by which the high temperature gas is brought into intimate contact with the surface of the billet, thus, effecting a rapid and efficient thermal transfer.

While the fan 16 for recirculating the expended primary and secondary air after it impinges on the surface of the billet serves the purpose of passing the air through the heaters to reheat the same to the proper temperature, it also protects the heating elements 15 by having air flow at least six feet per second to give the heaters longer life and make furnace operation more efficient.

By discharging the reheated air into the high temperature area, (i.e., the outer chamber 45) behind the baffles, under at least two inches of fan static pressure, it also assists the entrainment phenonomon of the jets acting through the aspiration throats.

The gases discharged against the billet after transferring a portion of their thermal energy to the billet are withdrawn through the duct 41 and the return ducts 43, 44 and **44*a* to be reheated and returned to the outer or primary air chamber. The operation of the fan 16 creates a negative pressure condition within the duct 41, thus, inducing the air to enter this duct and be recycled in the inner chamber 58** to exit through the heaters rather than attempt to return directly to the main chamber.

The inner chamber is, in effect, a passage restricted to the vicinity immediately about the billet. It will be noted that the inner chamber or passage is also a restricted tunnel extending the length of the apparatus. It will be seen in FIG. 2 that this tunnel passes beneath the plenum chamber 30 and, thus, in the immediate vicinity of the conveyor and the billet provides a continuous passage for air extending the length of the machine. Since the fans 17 serving the primary heating chambers are constantly pulling air from the preheat chamber by creating a substantial negative pressure in the duct 60, the preheat chamber will have a negative pressure with respect to this tunnel. Makeup air will be continuously flowing or counter-flowing along this tunnel to return air from each of the primary heating chambers to the preheat chamber. By this arrangement, substantial quantities of thermal energy are introduced to the preheat chamber even without use of the heaters 15 with which this chamber is equipped. It will be understood from this description that the invention provides a self-contained unit in which the heated gases are continuously recirculated with the only makeup air required being that necessary to makeup losses when the billets are charged and discharged and for any air leaks.

The apparatus provides an efficient and rapid means of heating a billet to a suitable temperature. Because of its particular design, it effects the heating rapidly and with a minimum of thermal losses, thus, marketedly conserving energy.

While a preferred embodiment of this invention has been illustrated and described, it will be recognized that various modifications can be made without departing from the principles of the invention. Such modifications are to be considered as included within the hereinafter appended claims, unless these claims by their language expressly state otherwise.

The embodiments of the invention in which an exclusive property or privilege is claimed are defined as follows:

1. An apparatus for heating a billet of metal to a temperature suitable for reworking said metal by compressive forces, said apparatus having an elongated, insulated tunnel and support means therein along which the billet can be moved through said apparatus, said apparatus comprising: said tunnel defining a primary air chamber, a source of primary heated air connected to said primary chamber; a tubular element; a source of secondary heated air connected to said tubular element; said tubular element being within said primary air chamber for discharging a high velocity jet of heated secondary air in a direction in which the air would impinge upon a billet on said support means; restriction means within said tunnel and dividing it into an inner chamber and an outer chamber, said inner chamber surrounding said support means; said restriction means being adjacent said tubular element and defining a throat in the path of discharge of said jet and through which said jet passes, said throat being shaped to induce entrainment of primary air from said primary chamber by said jet of air whereby a high velocity stream of mixed primary and secondary air is impinged upon the billet.

2. An apparatus for heating a billet of metal to a temperature suitable for reworking said metal by compressive forces, said apparatus having an elongated, insulated tunnel and support means therein along which the billet can be moved through said apparatus, said apparatus comprising: baffle means extending lengthwise of said tunnel dividing it into inner and outer chambers, said inner chamber generally surrounding the area through which a billet will move when mounted on said support means; said baffle means defining a slot-like, restricted aspiration throat providing communication between said chambers; a source of primary high temperature air connected to said outer chamber; a source of secondary heated air under pressure; an air supply element having a restricted jet forming discharge orifice adjacent to and directed at said aspiration throat; said secondary source of heated air connected to said air supply element for creating a high velocity air jet at said orifice for entraining primary air from said outer chamber, inducting it through said throat for impingement on a billet in the inner chamber.

3. The apparatus as described in claim 2 wherein an air exhaust and return duct communicates with the lower portion of said inner chamber and said primary air source.

4. The apparatus as described in claim 2 wherein said baffle has walls on each side of said throat, said walls extending toward said inner chamber and converging toward each other to form a generally V-shaped aspiration zone at the outer chamber side of said throat.

5. An apparatus for heating a billet of metal to a temperature suitable for reworking said metal by compressive forces, said apparatus having an elongated, insulated tunnel and support means therein along which the billet can be moved through said apparatus, said apparatus comprising: baffle means extending lengthwise of said tunnel dividing it into inner and outer chambers, said inner chamber generally surrounding the area through which a billet will move when mounted on said support means; said baffle means defining a plurality of slot-like, restricted throats, said throats being spaced apart circumferentially of said inner chamber and providing communication between said chambers; a source of primary high temperature air connected to said outer chamber; a source of secondary heated air under pressure; an air supply element having a restricted jet forming discharge orifice adjacent to and directed at each of said aspiration throats; said secondary source of heated air under pressure connected to all of said air supply elements for creating a high velocity air jet at each of said orifices for entraining primary air from said outer chamber, inducting it through said throats for impingement on a billet in the inner chamber.

6. The apparatus as described in claim 5 wherein said baffle means is comprised of a plurality of elongated members of generally triangular cross section arranged laterally of said tunnel in a generally circular configuration with their base portions defining the outer periphery of said inner chamber; said baffle members being spaced apart to form said restricted throats between each pair of members; the sides of said members converging inwardly to form a generally V-shaped aspiration zone at the outer chamber side of each of said throats.

7. The apparatus described in claim 6 wherein the orifice of each of said air supply elements is in each case within said aspiration zone defined by said sides of said baffle members.

8. The apparatus described in claim 7 wherein said air supply elements are within said aspiration zones and said orifices are closely adjacent said throats.

9. The apparatus described in claim 8 wherein an air exhaust and return duct communicates with said inner chamber, said duct having discharge opening communicating with said outer chamber; a heating means and a fan mounted in said duct intermediate its ends.

10. The apparatus described in claim 9 wherein said heating means is electrical.

11. The apparatus described in claim 9 wherein said apparatus has a primary heating zone and a preheating zone for effecting the initial heating of billets entering the apparatus; an air conduit communicating with said duct and said preheating zone for directing a portion of the air received by said duct to said preheating zone; an air passage connecting said preheating zone with said air supply elements and means in said air passage for pressurizing the air entering said air supply elements.

12. The apparatus as described in claim 11 wherein said apparatus has a plurality of primary heating zones and said air conduit provides communication between the return ducts in each of said zones and said preheating zone and said air passage connects said preheating zone with the air supply elements in each of said primary zones.

13. The apparatus as described in claim 6 wherein the air in said air supply elements is maintained in the range of 400°–700° F. and the air in said outer chamber is maintained in the range of 1000°–1500° F.

14. The apparatus as described in claim 6 wherein an air exhaust and return duct is provided having its intake end communicating with said inner chamber and its discharge end communicating with said outer chamber; air flow passages in said apparatus interconnecting said duct and said air supply elements for diverting a portion of the air received by said duct to said air supply elements.

* * * * *